US007069714B2

(12) United States Patent
De Boni

(10) Patent No.: US 7,069,714 B2
(45) Date of Patent: Jul. 4, 2006

(54) METAL COVERED COMPOSITE YARN, PARTICULARLY FOR ORNAMENTAL PURPOSES

(76) Inventor: Daniele De Boni, 36100 Vicinza, Via Casarsa 40 (IT)

( * ) Notice: Subject to any disclaimer, the term of this patent is extended or adjusted under 35 U.S.C. 154(b) by 36 days.

(21) Appl. No.: 10/637,371

(22) Filed: Aug. 7, 2003

(65) Prior Publication Data

US 2005/0028512 A1 Feb. 10, 2005

(51) Int. Cl.
*D02G 3/02* (2006.01)

(52) U.S. Cl. ..... 57/210

(58) Field of Classification Search ..... 57/210, 57/212, 229, 231
See application file for complete search history.

(56) References Cited

U.S. PATENT DOCUMENTS

| | | | | |
|---|---|---|---|---|
| 2,395,935 A | | 3/1946 | Morgan et al. | 288/12 |
| 2,458,243 A | | 1/1949 | Biddle | 57/140 |
| 2,974,055 A | | 3/1961 | Scharf | 117/4 |
| 3,126,698 A | | 3/1964 | Scharf | 57/144 |
| 3,361,616 A | | 1/1968 | Scharf | 161/175 |
| 3,667,098 A | | 6/1972 | Levy | 29/160.6 |
| 3,783,081 A | | 1/1974 | Levy | 161/7 |
| 4,387,555 A | | 6/1983 | Robinson | 57/235 |
| 4,449,353 A | * | 5/1984 | Tayebi | 57/242 |
| 4,776,160 A | | 10/1988 | Rees | 57/210 |
| 5,201,169 A | | 4/1993 | Miyashita | 57/7 |
| 5,632,137 A | | 5/1997 | Kolmes et al. | 57/212 |
| 5,881,547 A | | 3/1999 | Chiou et al. | 57/216 |
| 5,927,060 A | | 7/1999 | Watson | 57/210 |

FOREIGN PATENT DOCUMENTS

| | | |
|---|---|---|
| EP | 0 399 721 | 5/1990 |
| EP | 0 911 435 A2 | 10/1998 |
| EP | 0 911 435 A3 | 10/1998 |
| FR | 2 643 914 | 3/1989 |

* cited by examiner

*Primary Examiner*—John J. Calvert
*Assistant Examiner*—Shaun R Hurley
(74) *Attorney, Agent, or Firm*—Cislo & Thomas, LLP

(57) ABSTRACT

A metal covered composite yarn, particularly designed for ornamental purposes, comprises a textile non-metal core formed by a plurality of substantially parallel ultra-thin filaments, a metal cover formed by a relatively thin metal foil ribbon which is spirally wound around the core. The filaments have a substantially lapped or mirror surface finish to minimize resistance to sliding between adjacent filaments and provide a considerable core compliance, and a high yarn softness and flexibility.

29 Claims, 3 Drawing Sheets

FIG. 1
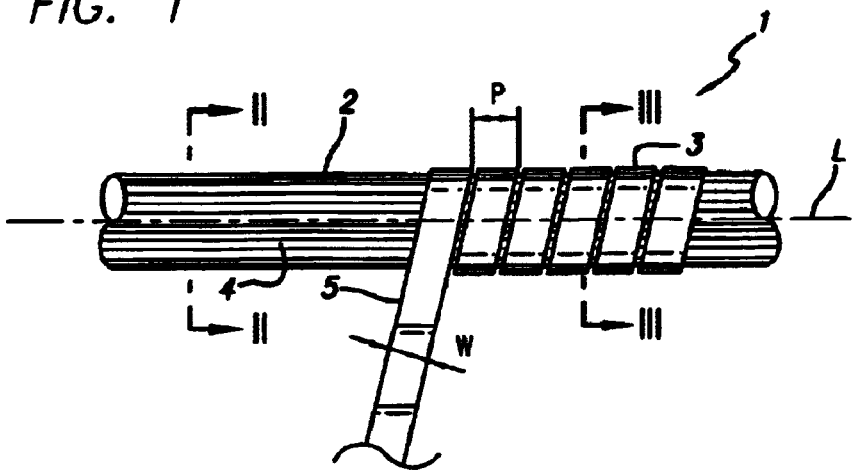
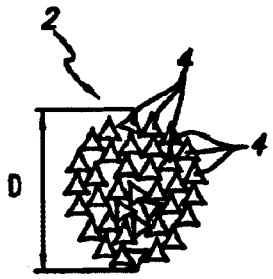
FIG. 2
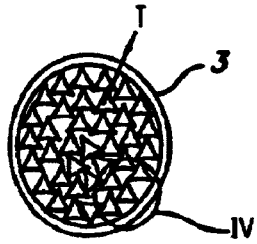
FIG. 3
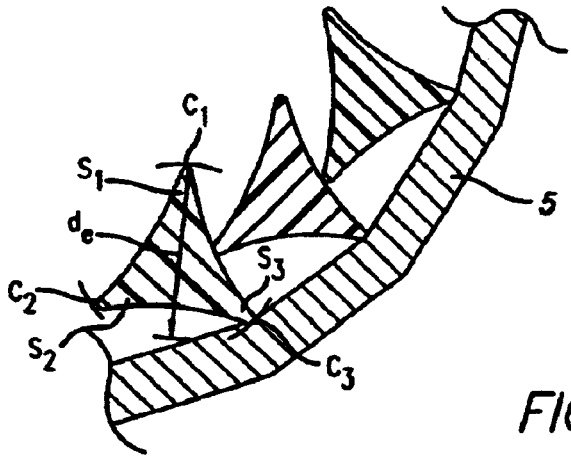
FIG. 4

METAL COVERED COMPOSITE YARN, PARTICULARLY FOR ORNAMENTAL PURPOSES

CROSS-REFERENCES TO RELATED APPLICATIONS

This patent application is related to Italian Patent Application Serial Number V12003A000056 filed Mar. 20, 2003.

BACKGROUND

Metal covered composite yarns have been known for many years and are essentially formed by a fibrous, non-metallic core covered with a thin metal foil ribbon or band having high reflecting properties, e.g. made of gold, silver or copper.

The composite yarn so obtained has a pleasant and highly glossy appearance and may be woven, knitted or variously disposed to make fabrics, clothing products, necklaces, earrings, rings and other fashion accessories in general.

U.S. Pat. No. 3,126,698 discloses a composite material, lame yarn, for use in production of fabrics and similar articles, which yarn is formed by a natural or synthetic, non-metallic core covered with a spirally wound metallized band.

The metallized band is formed by a transparent and flexible, thermoplastic base made of cellophane, acetate, Mylar or the like, on which a metal film made of gold, silver, aluminum, magnesium, titanium or nickel is deposited. Metal deposition may be carried out by various sputtering, electrodeposition or positive-ion bombardment techniques. The metallic layer may be coated with colored solutions or suspensions, having both an aesthetic and protective function. The composite yarn core may be formed by one or more filaments made of glass, nylon or natural or synthetic silk, in variable amounts depending on the desired structural strength.

This known metallized yarn has a higher softness than prior lame yarns, however the core is still rather stiff and has some elastic memory, especially when considering the friction existing between fibers due to the compression exerted by the outer metal cover. Moreover, the plating precious metal is provided in very small amounts, hence the final fineness of the yarn does not meet gold-making and jewelry market requirements and does not comply with regulations for gold-making practice.

U.S. Pat. No. 3,783,081 discloses an ornamental element for the fabrication of jewelry items, which element is formed by a yarn made of a first central rectilinear filament on which a second filament is spiraled, wherein the first and second filaments are at least partly made of a precious metal, such as gold or silver. The thus obtained yarn is then transversely compressed between opposed rollers, to form a flattened ornamental element. The flattened element is finally subjected to a thermal treatment to remove internal stresses caused by mechanical compression forces.

The finished ornamental element may be variously braided, woven, shaped and added to other ornaments to form a sort of "filigree," which may be used to fill empty spaces of jewels and create ornaments at a relative low cost, as compared with solid precious metal. A drawback of this prior art ornamental element is its relative stiffness, due to the fact that both its central core strand and its outside strand are at least partly made of metal and accordingly has a certain stiffness and a high elastic memory. Moreover, as the outer surface of the yarn is subjected to a compression step, its overall aspect is not sufficiently bright and glossy and has a relatively low ornamental attractiveness.

Other metallized composite yarns, to be used for ornamental purposes or as electric wires, are known from U.S. Pat. No. 4,387,555, FR-A-2643914, U.S. Pat. No. 5,201,169, U.S. Pat. No. 3,361,616, EP-A-399721, U.S. Pat. No. 5,927,060, EP-A-0 911 435 and U.S. Pat. No. 5,632,137.

Also, these prior art composite yarns do not have a sufficiently compliant and light core to provide a highly soft and flexible yarn. Moreover, when these yarns are used for ornamental purposes, their precious metal fineness is relatively lower than that of the jewel or golden product in which it is integrated. Finally, the metal covering foil is often suffering delamination, whereby the aesthetic characteristics of the product may be damaged or impaired.

The present invention relates to a metal covered composite yarn, which is particularly but not exclusively designed for ornamental purposes. The composite yarn of the invention may be generally employed in the field of jewelry, goldsmith art, costume jewelry, textile industry, or for the manufacture of jewels, fashion items and similar objects having a considerable softness and lightness as well as a relative low price.

Thanks to the high electrical conductivity of the metal cover, the composite yarn of the present invention may be also advantageously used as a highly flexible electric conductor applicable in the fields of electric or electronic apparatus, computer, nano-technology and aerospace industry. The invention further relates to a method of manufacturing the above-mentioned composite yarn.

SUMMARY

A main object of the present invention is to obviate the above-mentioned drawbacks, by providing a precious or semi-precious metal covered composite yarn having high flexibility and softness properties as compared with currently marketed composite yarns.

Another particular object is to provide a composite yarn as mentioned hereinbefore which is considerably light relative to its structural strength and is less expensive than prior art composite yarns.

A further object is to provide a composite yarn having a very low elastic memory, to ensure malleability in normal gold-making processes and to be even capable of being woven or knitted.

Yet another particular object is to provide a highly simple, accurate and easily repeatable method of making the composite yarn of the invention, with no risk of damaging or reduction of its intrinsic value due to delamination or fracture.

These objects, as well as other objects which will be more apparent hereinafter are achieved by a metal covered composite yarn, particularly for ornamental purposes, comprising a textile non-metal core, formed by a plurality of substantially parallel ultra-thin filaments, and a metal plating formed by a relatively thin metal foil ribbon spirally wound around said core, wherein said filaments have a substantially lapped or mirror surface finish to minimize resistance to sliding between adjacent filaments.

Due to this particular configuration, the composite yarn of the invention has a considerable compliance and deformability, and has such a low elastic memory as to provide a remarkable softness and multi-directional flexibility.

Finally, due to the relatively large metal cover volume as compared with the overall yarn, said cover has a relatively small percentage by weight, whereby the weight and cost of the overall yarn are lower as are the weight and cost of the products made with the yarn.

Advantageously, the filaments have a size of 5 dtex and 80 dtex and preferably of 33 dtex. The core may be formed by 3 to 200 filaments, but preferably less than 25 filaments. Due to the trilobal shape of the filaments, the outside diameter of the core is smaller than the sum of the outside diameters of the filaments composing it. Suitably, the non-metal material of the filaments is selected from the group of thermoplastic resins and natural or synthetic silk.

A method of manufacturing a composite yarn according to the invention may include providing a plurality of non-metal, small-diameter filaments, forming a bundle of said filaments to define a textile core, and providing a relatively thin metal foil ribbon, spiraling said metal foil ribbon around said core to form a metal cover, wherein the surface of said filaments is lapped or polished to minimize resistance to sliding between adjacent filaments which are non directly in contact with the outer surface.

Suitably, the filaments that form the core are substantially parallel and untwisted. Additionally, the metal foil ribbon is obtained from a base wire made of a gold-, platinum- and/or silver-based metal alloy, subjected to successive drawing steps to change its diameter from 0.4 mm to about 0.03 mm. Each drawing step is appropriately followed by an annealing treatment to increase ductility and prevent fracture of the base wire. Annealing treatments are carried out at temperatures of about 350° C. to about 550° C.

The base wire obtained by successive drawing steps is subjected to a rolling process to obtain a metal foil strip with predetermined average thickness and width, i.e. of about 0.01 mm and about 0.3 mm respectively. The rolling step may be carried out by using a pair of slightly convex opposed rollers, which have the maximum diameter at the middle and a gradually decreasing diameter toward the ends, and substantially lapped surfaces.

The foil ribbon is wound around a coiling reel at a driving speed that is in perfect synchronism with the speed of the wire feed to the rolling mill, to prevent the ribbon from breaking. The strip spiral winding operation is carried out in a controlled environment and at a very high speed, preferably of 20,000 to 30,000 rpm, and preferably of approximately 27,000 rpm.

BRIEF DESCRIPTION OF THE DRAWINGS

Further features and advantages will be more clearly apparent from the detailed description of a preferred but non-exclusive embodiment of the metal-covered composite yarn according to the invention, which is described hereinafter by way on non-limiting example with the assistance of the annexed drawings, in which:

FIG. 1 is a side view of a portion of the composite yarn according to the invention, partly fragmented to better show its components.

FIG. 2 is a sectional view of a yarn as shown in FIG. 1, as taken along line II—II.

FIG. 3 is a sectional view of a yarn as shown in FIG. 1, as taken along line III—III.

FIG. 4 is an enlarged sectional view of a detail of FIG. 3.

DETAILED DESCRIPTION

Figure 5:
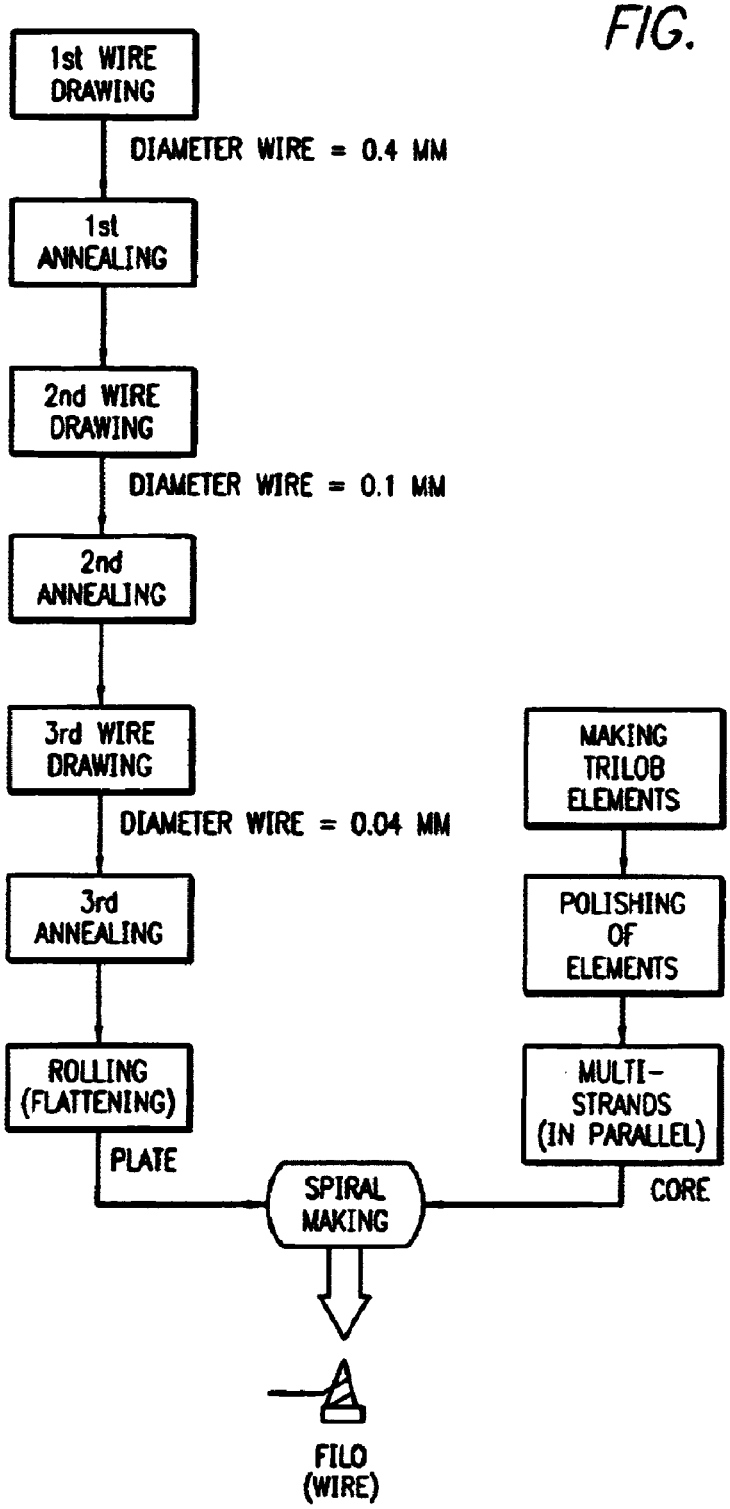
FIG. 5 is a block diagram of a process of fabrication of the yarn as shown in the previous figures.

The detailed description set forth below in connection with the appended drawings is intended as a description of exemplary embodiments and is not intended to represent the only forms in which the embodiments may be constructed and/or utilized. The description also sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

With reference to the above figures, a composite yarn according to an exemplary embodiment of the present the invention, generally designated by the reference numeral 1, essentially comprises a textile non-metallic core 2 and an outer peripheral metal cover 3. Yarn 1, including core 2 and cover 3, extends along a longitudinal axis L which is substantially rectilinear at the start.

Particularly, core 2 has a substantially cylindrical shape with an outer diameter D, and is composed of a certain number of filaments 4, having an outer diameter de, which are untwisted and parallel along the longitudinal axis L of the yarn. The filaments 4 are fabricated with conventional methods known in the field of fibers, with a high-resistance non-metal base material, e.g. selected from the group of resins or natural or synthetic silk. Particularly, resins may be selected from the group including polyester, polyolefin, polycarbonate, polyethylene, glass fiber, Mylar and nylon materials. Suitably, the base material may be added with fire retardants, to reduce fire hazards.

Cover 3 is generally obtained by spirally winding a metal foil strip or ribbon 5 around the core 2, which is an optimal support to permanently hold the filaments 4. Particularly, the base metal of the foil may be an alloy of precious or semi-precious metals, such as gold, silver, platinum. Possibly, other non-precious metals, such as copper, zinc, magnesium, nickel, may be added to the base elements, in amounts lower than 30%, to provide the alloys particular ductility and oxidation resistance. A few examples of possible alloys are listed below:

850 White: Au850 Cu30 Zn30 Nik90

850 Zenith: Au850 Ag62 Cu88

670 White: Au670 Ag5 Cu238 Nik55 Ott32

According to the invention, each filament 4 has a smooth, polished or lapped outer surface to provide the body with a higher gloss, and especially to obtain a very low friction factor, to correspondingly reduce the resistance to sliding between filaments. Thus, at least most of the filaments 4 may be free to move, thereby allowing the core 2 and the yarn in general to be considerably flexible and soft. Also, each filament 4 may have a substantially circular cross section.

Alternatively, its cross section may be polygonal, particularly trilobal or the like, i.e. having at least three lobes S1, S2, S3. Accordingly, at the lobes S1, S2, S3, the generatrices C1, C2, C3 of the cylindrical body of each filament 4 form respective substantially linear contact surface with respect to the adjacent filaments 4 of the bundle.

The individual filaments have a very low weight, such that the overall bundle has a textile specific size of 5 dtex to 80 dtex and preferably of approximately 33 dtex. The label "dtex" is the linear density decitex, which may correspond to $0.1\times10^{-6}$ kg/m. The bundle may be composed of 3 to 200 filaments 4. In a preferred embodiment, the number of filaments is lower than 25.

Thanks to their particular polygonal or lobed section, the filaments 4 may be bunched and compacted to reduce their encumbrance. Thus, the outside diameter D of the bundle, which defines core 2, will be smaller than the sum of the outer diameters de of the filaments 4 composing it, and the yarn structure will be ultra-thin and light.

Ribbon 5 defining cover 3 may have an average thickness T of 0.005 and 0.02 mm and preferably of approximately 0.01 mm. The average width W of the ribbon may be of 0.2 mm and 0.4 mm, preferably of approximately 0.3 mm. Ribbon 5 may be wrapped around core 2 along a helical path in adjacent turns 5, with a pitch P between turns of about 3 turns/mm.

If ribbon 5 is wound with a minimum tension, compatible with the tensile strength of the foil, it may be permanently adhered against filaments 4, so as to seem glued on the surface thereof. This will prevent the cover from delamination and reduce the risk of damage or aesthetic deterioration of the overall yarn.

In order to make the metal covered composite yarn 1 of the invention, a method may be used that comprises the following steps. The first step of the method provides formation of filaments 4 by melt-spinning, by using an apparatus capable of making fibers with a circular, polygonal or preferably trilobal cross-section. In a further surface finishing step, the filaments will be suitably polished or lapped to provide their outer surfaces with a glossy appearance and a minimum friction factor.

In a further step a certain number of filaments 4, i.e. about 25 filaments, are gathered and disposed parallel to the longitudinal axis L, without imparting thereto any axial twisting or winding force so as to form a core 2. Subsequently, a metal foil ribbon 5 is prepared and spirally wound around core 2 to form a metal cover 3.

The metallic ribbon 5 is prepared starting from a step in which a highly ductile gold- and/or silver-based metal alloy is drawn to obtain a wire with a maximum diameter of about 0.4 mm. The so obtained metal wire has internal stresses and is slightly hardened, and therefore it is subjected to a first relieving and annealing step, at temperatures of 450° C. to 550° C., depending on the alloy composition.

Then, the metal wire is subjected to further drawing steps to progressively reduce its minimum diameter to a value of approximately 0.04 mm, which steps are intercalated by respective relieving and annealing steps. The last thermal treatment, which is carried out on the 0.04 mm minimum diameter wire, at a temperature of approximately 400° C., and at a speed of about 1 m/sec, has the only purpose of laying the material while leaving its mechanical properties unchanged. The selection of treatment temperatures and times is particularly important for the integrity and malleability of the metal wire, and shall be made on a case-by-case basis according on the alloy composition.

Figures 6, 7:
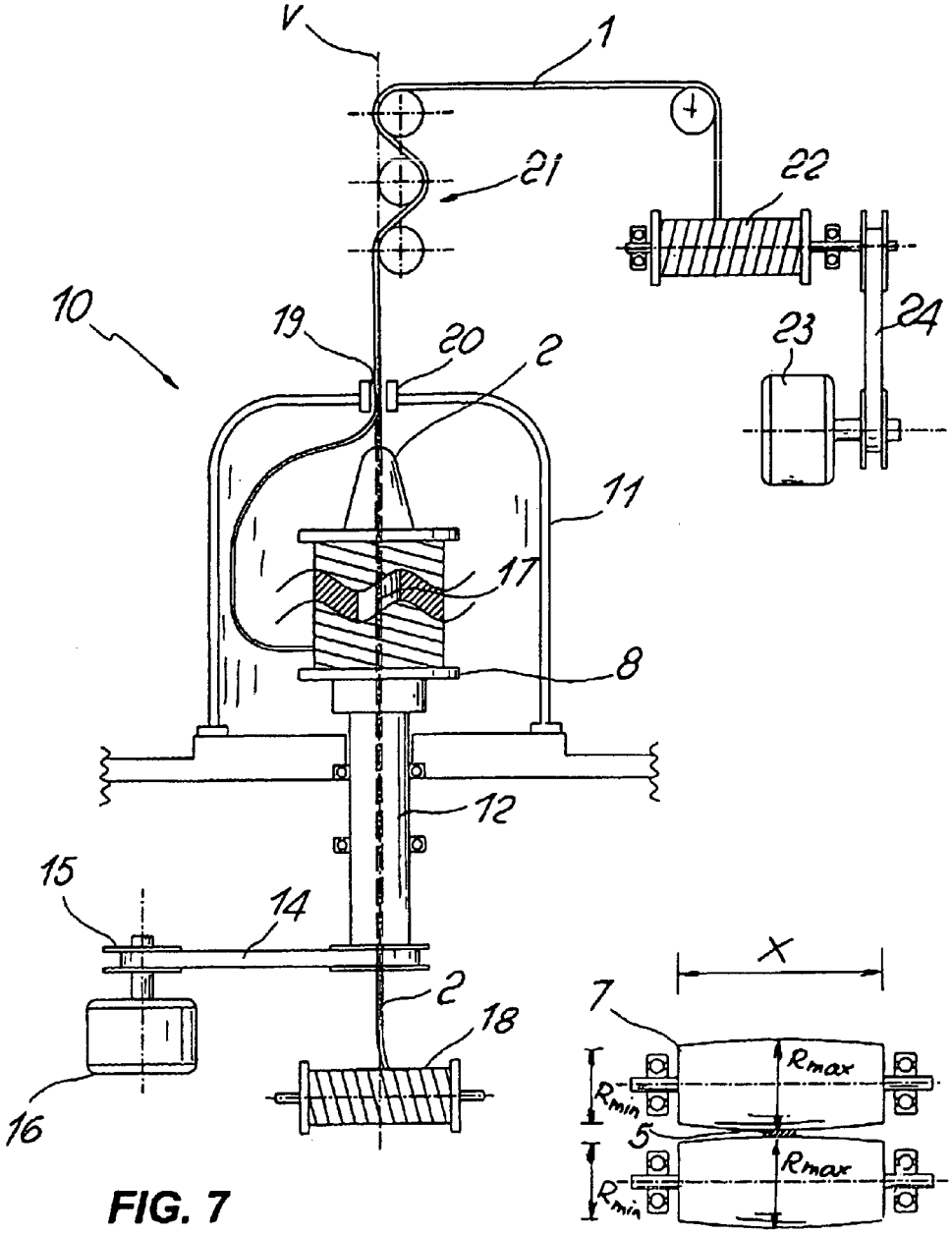
FIG. 6 is a functional schematic drawing of a rolling device for carrying out a step of the method of FIG. 5.
FIG. 7 is a functional schematic drawing of a spiraling apparatus for carrying out another step of the method of FIG. 5.

At this point, the metal wire is subjected to a rolling process to obtain a metal foil ribbon with an average thickness of about 0.01 mm and an average width of about 0.3 mm. The rolling process may be accomplished by compression using at least one pair of opposed rollers 7, as schematically shown in FIG. 6 and designated by numerals 6, 7 whose particular shape is selected to obtain a perfectly flat ribbon section. To this end, rollers 6, 7 have substantially lapped surfaces and are not perfectly cylindrical but have a slight symmetrical bulge, with a maximum diameter $R_{max}$ at the middle and decreasing toward the ends to a minimum diameter $R_{min}$.

As a non limiting example, by using rollers having a maximum diameter $R_{max}$ of about 150 mm and a maximum width X of about 100 mm, the percentage change in the diameter of the rollers 6, 7 may be of about 1% to 3%, preferably of about 2%, i.e. of about 3 mm.

At the output of the rollers, the metal foil ribbon 5 is wound around a coiling spindle or reel 8 which rotates at a speed that is electronically synchronized with the speed of the wire fed to the rolling mill, to prevent it from breaking during the winding operation. At this stage, spindle 8 is inserted in a spiraling apparatus, which is schematically shown in FIG. 7, and is generally designated by reference numeral 10. In more details, the apparatus has a protection area formed by a removable 11 bell, preferably made of a transparent material, to allow proper operation monitoring, wherein the spindle or spool 8 is housed. The bell rests on a stationary support and is fitted onto a shaft 12 supported by bearings, to rotate about a vertical axis V. Shaft 12 is coupled by a pulley 12 and a belt to a drive pulley of a motor 16. Spindle 8 and shaft 12 are hollow and form an axial path 17, through which textile core 2 unwound from a spool 18 is fed.

Bell 11 has an opening 19 at its top with a bush 20 made of a highly resistant and extremely low-friction material, for the passage of the spiraled and finished wire 1. A train of driving rollers 21 is disposed above bell 11, to feed the finished composite yarn at a controlled speed, perfectly synchronized with the feeding speed of core 2 to prevent stresses and fractures. Then, the yarn is wound on a coiling reel 22, driven by a motor 23 though a belt 24.

Ribbon 5 is projected against the inner wall of the bell due to the centrifugal force induced by the high-speed rotation of spindle 8 fitted on shaft 12, which rotates at a speed of about 20,000 to 30,000 rpm, preferably at about 27,000 rpm. Thanks to the shape of spindle 8, to the geometry of the inner wall of the bell and to the motion of the core relative to the spindle 8, ribbon 5 is automatically deposed on core 2 along a helical path with adjacent turns and constant pitch P.

By suitably adjusting the rotation speed of the spindle 8 and the feed speed of the finished yarn 1, spiraling may be carried out with a pitch of about 0.3 mm, so that a minimum distance of 0 mm to 0.1 is provided between turns. Thus, the mirror surface of the core filaments may be glimpsed from between the turns, and the gloss effect of the finished yarn is thereby increased.

From the above description it is apparent that the metal covered composite yarn of the present invention achieves the intended objects and particularly exhibits excellent softness and flexibility properties as well as a considerable light, though maintaining a precious material fineness similar to that of jewels wholly made of gold, silver and other precious metals.

Due to its lightness, the composite yarn according to the invention is particularly cost-effective, while providing a highly pleasant aesthetic effect. Furthermore, the conductivity properties of the composite yarn, in addition to its flexibility make it particularly suitable for use in electric and electronic apparatus including miniature or even micro-sized equipments.

The yarn and method according to this invention is susceptible to numerous modifications and changes all falling within the scope defined in the appended claims. All details may be replaced by other technically equivalents and the materials may any according to the different needs, without departing from the scope of the invention.

While the composite yarn has been described with particular reference to the accompanying figures, the numerals referred to in the disclosure are only used for the sake of a better intelligibility of the invention and shall not be intended to limit the claimed scope in any manner.

In closing, it is to be understood that the exemplary embodiments described herein are illustrative of the principles of the present invention. Other modifications that may be employed are within the scope of the invention. Thus, by way of example, but not of limitation, alternative configurations may be utilized in accordance with the teachings herein. Accordingly, the drawings and description are illustrative and not meant to be a limitation thereof.

What is claimed is:

1. A metal covered composite yarn, particularly for ornamental purposes, comprising:

a textile non-metallic core formed by a plurality of substantially parallel ultra-thin filaments;

a metal cover formed by a relatively thin metal foil ribbon which is spirally wound around said core;

wherein said filaments have a substantially lapped or mirror surface finish to minimize sliding resistance between adjacent filaments, thereby providing a considerable core compliance and a high yarn softness and flexibility; and wherein said filaments have a size of between 5 dtex and 80 dtex.

2. Composite yarn as claimed in claim 1, wherein said core is formed by about 3 to 200 filaments.

3. Composite yarn as claimed in claim 1, wherein said core has an outside diameter that is smaller than the sum of the outside diameters of the filaments composing said core.

4. Composite yarn as claimed in claim 1, wherein the filaments which define said core are parallel and untwisted.

5. Composite yarn as claimed in claim 1, wherein the non-metallic material of said filaments is selected from the group including thermoplastic resins and natural or synthetic silk.

6. Composite yarn as claimed in claim 1, wherein said resins are selected from the group including polyester, polyolefin, polycarbonate, polyethylene, glass fiber and nylon materials.

7. Composite yarn as claimed in claim 1, wherein said filaments have a substantially polygonal cross-section.

8. Composite yarn as claimed in claim 1, wherein said filaments have a substantially trilobal cross-section which defines substantially linear mutual contact areas.

9. Composite yarn as claimed in claim 1, wherein the metallic material that forms said foil is selected from the group including gold, platinum and silver-based alloys.

10. Composite yarn as claimed in claim 9, wherein said gold or silver based alloys also comprise non-precious metals, selected from the group including copper, zinc, nickel and brass.

11. Composite yarn as claimed in claim 10, wherein said added non precious metals are less than 30%.

12. Composite yarn as claimed in claim 1, wherein the average thickness of said foil is between 0.005 to 0.02 mm.

13. Composite yarn as claimed in claim 1, wherein the average width of said foil is between 0.2 to 0.4 mm.

14. Composite yarn as claimed in claim 1, wherein said foil is wrapped around said core along a helical path in adjacent turns, with a pitch between turns of about 3 turns/mm.

15. The metal covered composite yarn of claim 14, wherein said metal cover is spirally wound around said core.

16. A metal covered composite yarn, comprising:

a non-metallic core formed by a plurality of substantially parallel filaments;

a metal cover formed by a relatively thin metal foil, which is wound around said core;

wherein said filaments have a substantially smooth surface to minimize sliding resistance between adjacent filaments; and wherein said filaments have a diameter of 5 dtex to 80 dtex.

17. The metal covered composite yarn of claim 16, wherein said non-metallic core comprises 3 to 200 filaments.

18. The metal covered composite yarn of claim 16, wherein said non-metallic core has an outside diameter that is smaller than the sum of the outside diameters of the filaments composing said core.

19. The metal covered composite yarn of claim 16, wherein the filaments of said non-metallic core are parallel and untwisted.

20. The metal covered composite yarn of claim 16, wherein said filaments are thermoplastic resins, natural silk or synthetic silk.

21. The metal covered composite yarn of claim 20, wherein said thermoplastic resins are polyester, polyolefin, polycarbonate, polyethylene, glass fiber or nylon materials.

22. The metal covered composite yarn of claim 16, wherein said filaments have a substantially polygonal cross-section.

23. The metal covered composite yarn of claim 16, wherein said filaments have a substantially trilobal cross-section, which defines substantially linear mutual contact areas between said filaments.

24. The metal covered composite yarn of claim 16, wherein said metal foil is a gold, platinum or silver-based alloy, and combinations thereof.

25. The metal covered composite yarn of claim 24, wherein said gold and silver based alloys comprise non-precious metals including copper, zinc, nickel and brass.

26. The metal covered composite yarn of claim 25, wherein said non-precious metals comprise less than 30% of the mass of said metallic material.

27. The metal covered composite yarn of claim 16, wherein the average thickness of said metallic foil is 0.005 mm to 0.02 mm.

28. The metal covered composite yarn of claim 16, wherein the average width of said metallic foil is 0.2 to 0.4 mm.

29. The metal covered composite yarn of claim 16, wherein said metallic foil is wrapped around said core along a helical path in adjacent turns, with a pitch between turns of about 3 turns/mm.

* * * * *